US011220825B2

(12) United States Patent
Steffes et al.

(10) Patent No.: US 11,220,825 B2
(45) Date of Patent: Jan. 11, 2022

(54) SINGLE COURSE EXTERIOR CLADDING PANEL

(71) Applicant: CertainTeed LLC, Malvern, PA (US)

(72) Inventors: Stephen W. Steffes, McPherson, KS (US); Brian W. Kirn, Hatboro, PA (US)

(73) Assignee: CertainTeed LLC, Malvern, PA (US)

( * ) Notice: Subject to any disclaimer, the term of this patent is extended or adjusted under 35 U.S.C. 154(b) by 75 days.

(21) Appl. No.: 16/365,324

(22) Filed: Mar. 26, 2019

(65) Prior Publication Data

US 2019/0301173 A1 Oct. 3, 2019

Related U.S. Application Data

(60) Provisional application No. 62/650,337, filed on Mar. 30, 2018.

(51) Int. Cl.

| | |
|---|---|
| ***E04F 13/18*** | (2006.01) |
| ***E04D 1/34*** | (2006.01) |
| ***E04F 13/08*** | (2006.01) |
| ***E04D 1/20*** | (2006.01) |
| ***E04D 1/26*** | (2006.01) |

(52) U.S. Cl.

CPC ..... *E04F 13/0864* (2013.01); *E04D 1/20* (2013.01); *E04D 1/265* (2013.01); *E04D 1/34* (2013.01); *E04F 13/0889* (2013.01); *E04D 2001/3447* (2013.01); *E04F 13/18* (2013.01)

(58) Field of Classification Search

CPC ... E04F 13/0864; E04F 13/0889; E04F 13/18; E04F 13/0846; E04F 13/185; E04F 2201/0123; E04F 2201/0511; E04F 21/1855; E04F 13/083; E04F 13/0862;

(Continued)

(56) References Cited

U.S. PATENT DOCUMENTS 5,537,792 A * 7/1996 Moliere ..... E04D 1/265 52/531

6,635,218 B2 10/2003 King (Continued)

OTHER PUBLICATIONS

CertainTeed Corporation, "Installation Instructions, Cedar Impressions(R) Half-Round Shingles," May 2006.

(Continued)

*Primary Examiner* — Phi D A

(74) *Attorney, Agent, or Firm* — McDonnell Boehnen Hulbert & Berghoff LLP

(57) ABSTRACT

One aspect of the disclosure is an exterior cladding panel including a first end, a second end, and a series of locking clips extending from a front face of the exterior cladding panel and positioned along the first end of the exterior cladding panel. The exterior cladding panel also includes a locking leg extending from a rear face of the exterior cladding panel and positioned along a middle portion between the first end and the second end. The exterior cladding panel also includes a series of simulated shingles positioned in a single course between the first end and the second end, including a series of gaps separating adjacent shingles. Each gap extends lengthwise from the second end to the middle portion of the exterior cladding panel, and includes a first width that differs from a second width of at least one adjacent gap in the series of gaps.

22 Claims, 12 Drawing Sheets

(58) Field of Classification Search
CPC .. E04D 1/34; E04D 1/20; E04D 1/265; E04D 2001/3447; E04D 2001/3458
See application file for complete search history.

(56) References Cited

U.S. PATENT DOCUMENTS 6,715,250 B2 * 4/2004 Bryant ..... E04F 13/0864 52/522
6,725,618 B2 * 4/2004 Albracht ..... E04F 13/0864 52/489.1
D507,837 S * 7/2005 King ..... D25/141
6,955,019 B2 * 10/2005 Donlin ..... E04F 13/0864 52/314
6,976,342 B1 12/2005 Kowalevich
7,008,213 B2 * 3/2006 King ..... E04D 1/265 425/326.1
7,698,864 B2 * 4/2010 Justice ..... E04F 13/0864 52/519
7,735,286 B2 * 6/2010 Trabue ..... E04D 1/29 52/518
8,381,475 B2 * 2/2013 Carbines ..... E04F 13/0864 52/546
2002/0095901 A1 * 7/2002 Tremblay ..... E04D 1/34 52/543
2006/0026908 A1 * 2/2006 Gregori ..... E04D 1/265 52/105
2006/0130419 A1 * 6/2006 Bowman ..... E04F 13/0864 52/560
2007/0107356 A1 * 5/2007 Steffes ..... E04F 13/0864 52/518
2008/0083187 A1 * 4/2008 Dennis ..... E04D 1/265 52/527
2010/0205886 A1 * 8/2010 Carbines ..... E04F 13/0864 52/478
2011/0061323 A1 * 3/2011 Schwarz ..... E04F 13/0864 52/314
2014/0272273 A1 9/2014 Shaw
2015/0167315 A1 6/2015 Steffes

OTHER PUBLICATIONS

CertainTeed Corporation, "Accents" brochure, 2014.
CertainTeed Corporation, "Specification Sheet," Cedar Impressions(R), Nov. 2016.
CertainTeed Corporation, "Cedar Impressions(R)," 2010.
CertainTeed Corporation, "The Authentic Beauty of New CertainTeed® Cedar Impressions® Single 7-inch Perfection Shingle Siding Is Much More Than Skin Deep," Apr. 19, 2016.

* cited by examiner

SINGLE COURSE EXTERIOR CLADDING PANEL

CROSS-REFERENCE TO RELATED APPLICATIONS

This application claims the benefit of priority of U.S. Provisional Patent Application No. 62/650,337, filed Mar. 30, 2018, which is hereby incorporated herein by reference in its entirety.

BACKGROUND OF THE DISCLOSURE

1. Field of the Disclosure

The present disclosure relates generally to exterior cladding products and methods for installing and fabricating them. The present disclosure relates more particularly to exterior cladding panels, such as siding panels.

2. Technical Background

Polymer-based siding, such as polypropylene or vinyl siding, is among the most common exterior cladding systems used for residential construction in the United States. Polymer siding is typically manufactured into relatively large panels that include a series of adjacent surface courses that imitate the appearance of a wood clapboard surface. The panels are often installed with the siding courses in a horizontal orientation, and a given panel is usually engaged with the panels above and below it by way of interlocking clips or hooks included at the top and bottom of each panel. The result is an exterior cladding system that can be installed more easily, quickly, and more economically that many other alternatives.

However, a relatively large, multi-course polymer siding panel may be oversized for some applications. For instance, installing a double or triple course siding panel in the gable ends of a house may result in excessive waste, or scrap, that is trimmed from the panel due to the angle of the roof. In these applications and others, a single-course siding panel may be used to reduce the amount of waste. Further, a single-course siding panel may provide more flexibility in varying shapes or colors within an overall siding system.

Accordingly, what is needed is an improved, single course exterior cladding panel that provides for variation in its appearance and ease of installation, while also incorporating the structural needs of the exterior cladding panel.

SUMMARY OF THE DISCLOSURE

One aspect of the disclosure is an exterior cladding panel comprising:

a first end;

a series of locking clips extending from a front face of the exterior cladding panel and positioned along the first end of the exterior cladding panel;

a second end;

a locking leg extending from a rear face of the exterior cladding panel and positioned along a middle portion of the exterior cladding panel between the first end and the second end; and a series of simulated shingles positioned in a single course between the first end and the second end, wherein the series of simulated shingles comprises a series of gaps separating adjacent shingles in the series of simulated shingles, wherein each gap in the series of gaps extends lengthwise from the second end of the exterior cladding panel to the middle portion of the exterior cladding panel, and wherein each gap in the series of gaps comprises a first width that differs from a second width of at least one adjacent gap in the series of gaps.

Another aspect of the disclosure is an exterior cladding system comprising:

a first exterior cladding panel, wherein the first exterior cladding panel is the exterior cladding panel as described herein; and a second exterior cladding panel, wherein the first exterior cladding panel is the exterior cladding panel as described herein, and wherein the locking leg of the second exterior cladding panel is sized to engage the series of locking clips of the first exterior cladding panel.

Another aspect of the disclosure is an exterior cladding system comprising:

a first exterior cladding panel, wherein the first exterior cladding panel is the exterior cladding panel as described herein; and a second exterior cladding panel, wherein the second exterior cladding panel comprises:

a first end;

a second end; and a locking leg extending along an edge of the second end of the second exterior cladding panel; and wherein the locking leg of the second exterior cladding panel is sized to engage the second series of locking clips of the first exterior cladding panel.

Another aspect of the disclosure is a wall of a structure comprising an exterior sheathing and the exterior cladding system described herein attached thereto, where the first exterior cladding panel is fastened to the exterior sheathing via a fastening strip disposed along an edge of the first end of the first exterior cladding panel, and where the locking leg of the second exterior cladding panel is engaged with the series of locking clips of the first exterior cladding panel.

Another aspect of the disclosure is a wall of a structure comprising an exterior sheathing and the exterior cladding system described herein attached thereto, wherein the first exterior cladding panel is fastened to the exterior sheathing via a fastening strip disposed along an edge of the first end of the first exterior cladding panel, and wherein the locking leg of the second exterior cladding panel is engaged with the second series of locking clips of the first exterior cladding panel.

Another aspect of the disclosure is a method for installing an exterior cladding system as described herein, the method comprising:

fastening the first exterior cladding panel to the exterior sheathing via a fastening strip disposed along the edge of the first end of the first exterior cladding panel;

engaging the locking leg of the second exterior cladding panel with the series of locking clips of the first exterior cladding panel; and fastening the second exterior cladding panel to the exterior sheathing via a fastening strip disposed along the edge of the first end of the second exterior cladding panel.

Another aspect of the disclosure is a method for installing an exterior cladding system as described herein, the method comprising:

fastening the first exterior cladding panel to the exterior sheathing via a fastening strip disposed along the edge of the first end of the first exterior cladding panel;

forming the second series of locking clips, where forming the second series of locking clips comprises separating from the front face of the first exterior cladding panel, for a plurality of the protrusions extending from the front face of the exterior cladding panel, the portion of each protrusion facing the second end of the first exterior cladding panel;

engaging the locking leg of the second exterior cladding panel with the second series of locking clips of the first exterior cladding panel; and fastening the second exterior cladding panel to the exterior sheathing via a fastening strip disposed along the edge of the first end of the second exterior cladding panel Another aspect of the disclosure is a method for forming an exterior cladding panel as described herein, the method comprising:

injection molding the exterior cladding panel to include:

a first end;

a series of locking clips extending from a front face of the exterior cladding panel and positioned along the first end of the exterior cladding panel;

a second end;

a locking leg extending from a rear face of the exterior cladding panel and positioned along a middle portion of the exterior cladding panel between the first end and the second end; and a series of simulated shingles positioned in a single course between the first end and the second end, wherein the series of simulated shingles comprises a series of gaps separating adjacent shingles in the series of simulated shingles, wherein each gap in the series of gaps extends lengthwise from the second end of the exterior cladding panel to the middle portion of the exterior cladding panel, and wherein each gap in the series of gaps comprises a first width that differs from a second width of at least one adjacent gap in the series of gaps.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description herein serve to explain the principles and operation of the disclosure.

DETAILED DESCRIPTION

The present inventors have noted disadvantages of some conventional exterior cladding systems, such as polymer-based siding panels. As noted above, polymer siding is often manufactured in relatively large panels including a plurality of siding courses of similar height. The present inventors have noted that a single-course siding panel, due to its relatively smaller size, will repeat more frequently when it is utilized in a given siding system. In some cases, this repetition may result in undesirable visible patterns that can disrupt the simulated wood surface that the siding system is intended to provide.

Further, a single-course siding panel may be formed as series of simulated shingles separated by a series of gaps. In addition, each single-course siding panel that is installed will be separated from adjacent panels to its left or right by an installation gap. These installation gaps may be subject to change in width due to the thermal expansion of the siding panels post-installation. Such changes in width may be easily noticeable if the surrounding gaps have an otherwise uniform appearance.

The present inventors have determined that an exterior cladding panel may be formed, such as a polymer siding panel, for instance, that randomizes the gap widths between shingles such that a pattern is not as readily discerned. Further, the irregular gap widths within each panel may serve to mask the changes in gap widths that may occur in between exterior cladding panels due to heating and cooling of the panels. Accordingly, one aspect of the disclosure is an exterior cladding panel, such as a polymer siding panel, including a series of simulated shingles with a series of gaps separating adjacent shingles. Each gap in the series of gaps may include a first width that differs from a second width of at least one adjacent gap in the series of gaps.

Thus, the exterior cladding panel as described herein may introduce a random or irregular-looking pattern to the gaps between simulated shingles, which may provide for a more visually-appealing appearance to some. Moreover, the example exterior cladding panels discussed herein may more accurately recreate a genuine wood shingle appearance, which may include natural variation.

Figure 1:
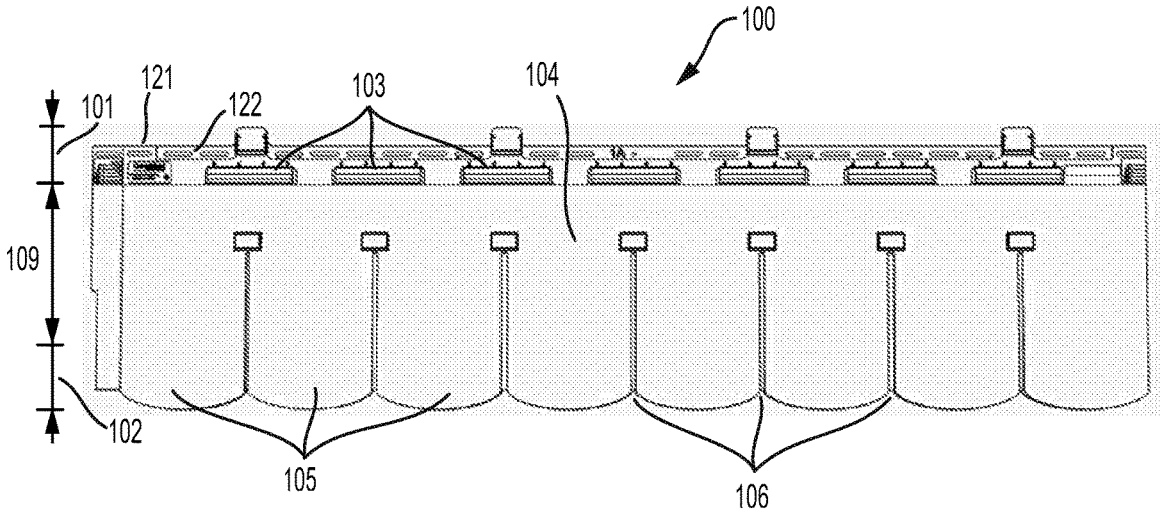
FIG. 1 is a schematic front view of an exterior cladding panel according to one embodiment of the disclosure.
Figure 2:
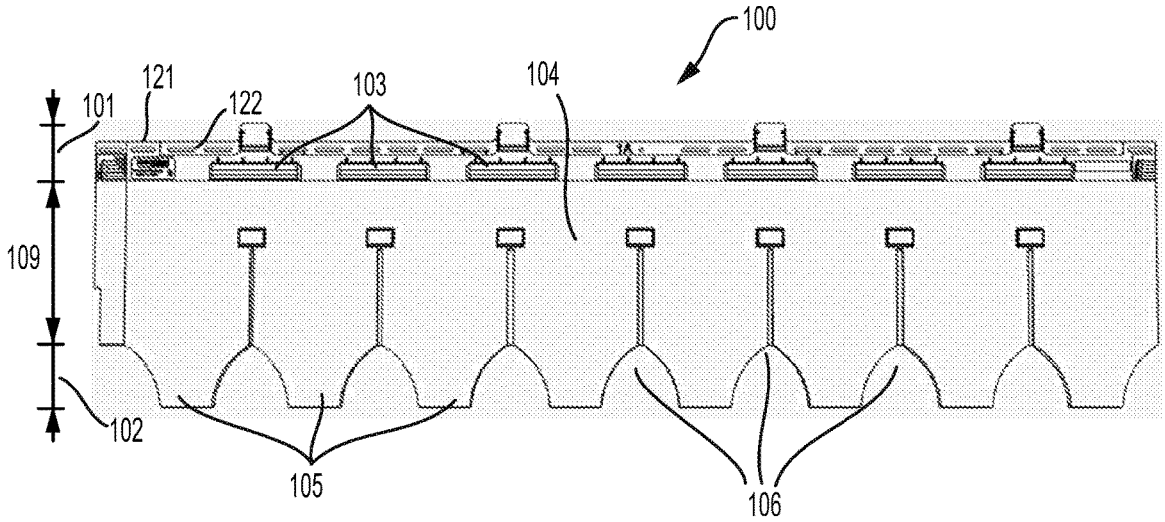
FIG. 2 is a schematic front view of an exterior cladding panel according to another embodiment of the disclosure.
Figure 3:
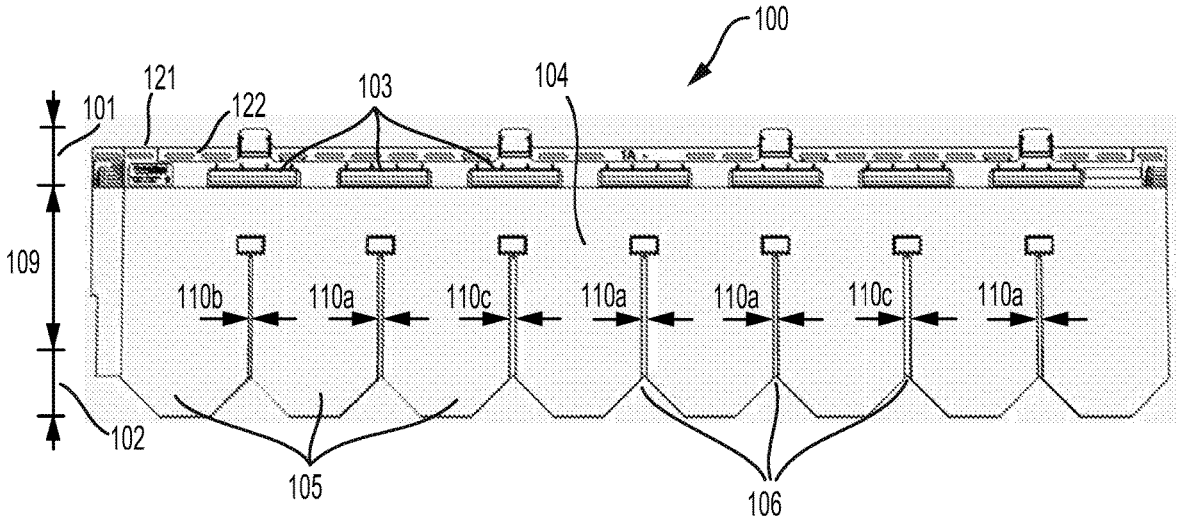
FIG. 3 is a schematic front view of an exterior cladding panel according to another embodiment of the disclosure.
Figure 4:
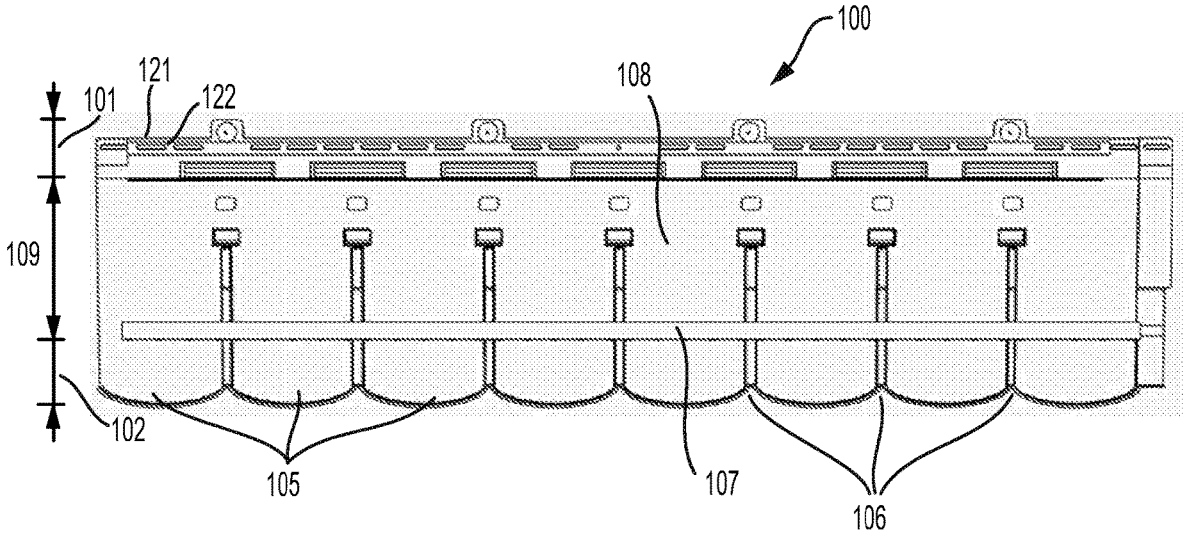
FIG. 4 is a schematic rear view of an exterior cladding panel according to another embodiment of the disclosure.

Several embodiments of such an exterior cladding panel are described with respect to FIGS. 1-13 below. For instance, FIGS. 1-3 show three examples of a schematic front view of an exterior cladding panel 100 according to certain embodiments of the disclosure. In each example, the exterior cladding panel 100 includes a first end 101, arranged in FIGS. 1-3 to be the top end of the exterior cladding panel 100. Further, the exterior cladding panel 100 includes a series of locking clips 103 extending from a front face 104 of the exterior cladding panel 100 and positioned along the first end 101 of the exterior cladding panel 100.

The exterior cladding panel 100 also includes a series of simulated shingles 105 positioned in a single course between the first end 101 and the second end 102. The series of shingles 105 may take a number of shapes. For example, in FIG. 1, the series of simulated shingles 105 include a rounded appearance, while the series of simulated shingles 105*a* in FIG. 2 have a more pointed, cove-like arrangement. Further, the series of simulated shingles 105*b* in FIG. 3 include a hexagonal shape at the second end 102 of the exterior cladding panel 100. In the examples shown in FIGS. 1-3, the shape of the shingles may constitute the only difference between the exterior cladding panels 100, as all other features are the same, or substantially the same. Accordingly, although many of the embodiments shown in the remaining Figures and discussed herein may generally depict the rounded shingles as shown in FIG. 1, it will be understood that the alternative shapes shown in FIGS. 2-3, or any other shapes, may also be utilized.

In certain embodiments as otherwise described herein, the exterior cladding panel 100 may include a fastening strip 122 disposed along an edge 121 of the first end 101, which can be seen most clearly in the examples shown in FIGS. 1-6. The fastening strip 122 may be used to fasten the exterior cladding panel 100 to the exterior sheathing of a wall of a structure, as further discussed below.

The exterior cladding panel 100 further includes a locking leg 107 extending from a rear face 108 of the exterior cladding panel 100. The locking leg 107 can be seen in FIG. 4, which shows a schematic rear view of the exterior cladding panel 100. In particular, the locking leg 107 is positioned along a middle portion 109 of the exterior cladding panel 100, between the first end 101 and the second end 102, and may be used to engage the exterior cladding panel 100 with a locking clip of an adjacent panel. Other locations for the locking leg 107 are also possible.

As shown in FIGS. 1-4, the series of simulated shingles 105 may include a series of gaps 106 separating adjacent shingles in the series of simulated shingles 105. Each gap in the series of gaps 106 may extend lengthwise from the second end 102 of the exterior cladding panel 100 to the middle portion 109 of the exterior cladding panel 100. Further, each gap in the series of gaps 106 may include a first width 110*a* that differs from a second width 110*b* of at least one adjacent gap in the series of gaps 106. In some implementations, the series of locking clips 103 may correspond to the series of gaps 106 such that each locking clip in the series of locking clips 103 is aligned with a respective gap in the series of gaps 106. Other arrangements for the series of locking clips 103 with respect to the series of gaps 106 are also possible.

As mentioned above, varying the gap widths between the shingles in the series of simulated shingles 105 may be desirable in order to create an irregular pattern that is relatively less noticeable to an onlooker. Similarly, the irregular pattern of gap widths can serve to obscure changes in width that may occur at the gap between installed panels, due to thermal expansion. Such changes in the gap width in between installed panels might otherwise be conspicuous if every other gap width is the same, or if a more regular pattern is used.

In certain embodiments as otherwise described herein, the first width 110*a* of a given gap may differ from the second width 110*b* of a first adjacent gap, and may also differ from a third width 110*c* of a second adjacent gap. For example, FIG. 3 shows each of the gaps in the series of gaps 106 individually labeled with one of three widths, 110*a*, 110*b*, or 110*c*. The second gap in the series from the left, for instance, has a width 110*a*, which differs from the first adjacent gap to the left (i.e., the first gap in the series), which has a width 110*b*, and also differs from the second adjacent gap to the right (i.e., the third gap in the series), which has a width of 110*c*.

As another example, the width of a given gap in the series of gaps 106 may differ from both adjacent gaps, however both adjacent gaps may have the same width. Such an example is shown in FIG. 3 with respect to the third gap in the series, which has a width 110*c*. Both the adjacent second and adjacent fourth gaps in the series have a width 110*a* that differs from the width 110*c*, however they are the same as each other, Still further, considering the fourth gap in the series of gaps 106 as shown in FIG. 3, the first width 110*a* may differ from a second width 110*b* of a first adjacent gap (i.e., the third gap in the series, to the left), but be the same as a third width 110*a* of a second adjacent gap (i.e., the fifth gap in the series, to the right).

As shown in some embodiments of the exterior cladding panel 100 discussed above, a given gap width may be repeated within the series of gaps 106. Nonetheless, the series of gaps 106 may include at least three gaps having mutually different widths, as shown by the widths 110*a*, 110*b*, and 110*c* the example of FIG. 3. This, in addition to the sequencing of the differing widths, may introduce a level of apparent randomness that makes the detection of patterns in the gaps less likely. Further conventions may also be followed relating to the arrangement of the gaps widths as well. For instance, no more than two consecutive gaps in the series of gaps 106 may have the same width. Other examples are also possible.

In certain embodiments as otherwise described herein, the series of locking clips 103 may be a first series of locking clips 103, and the exterior cladding panel 100 may further include a second series of locking clips 113 extending from the front face 104 of the exterior cladding panel 100. For instance, the second series of locking clips 113 may be positioned in the middle portion 109 of the exterior cladding panel 100, between the first series of locking clips 103 and the series of gaps 106, as shown in FIGS. 1-3. In some implementations, the second series of locking clips 113 may correspond to the series of gaps 106 such that each locking clip in the second series of locking clips 113 is aligned with a respective gap in the series of gaps 106. Other arrangements for the second series of locking clips 113 with respect to the series of gaps 106 are also possible. Further, the rationale for providing two series of locking clips in different locations on the exterior cladding panel 100 will be discussed below, and will be more readily understood with reference to FIG. 13.

Figure 5:
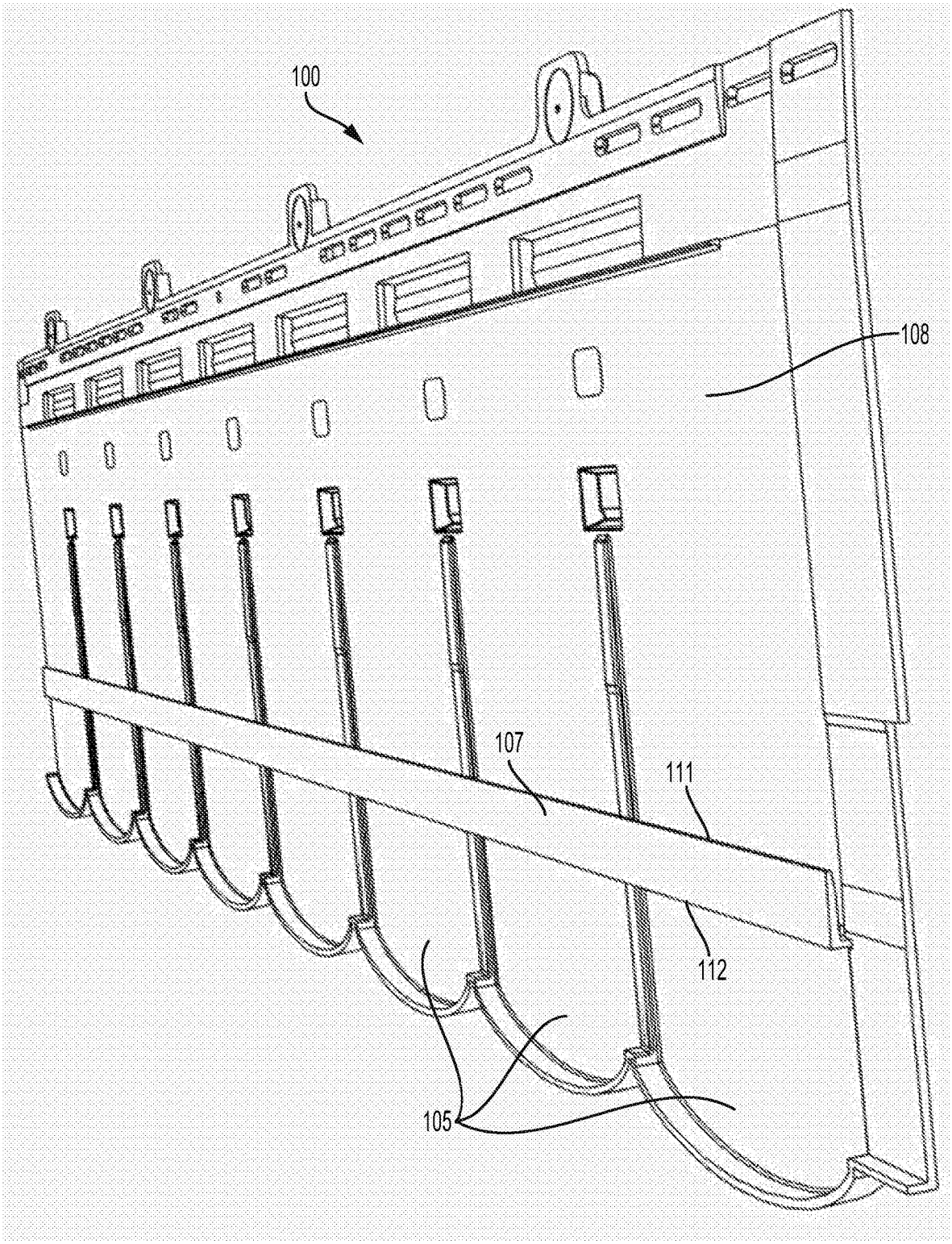
FIG. 5 is a schematic perspective view of a rear face of an exterior cladding panel according to another embodiment of the disclosure.

Turning now to FIG. 5, a schematic perspective view of the rear face 108 of an example exterior cladding panel 100 is shown. The locking leg 107 can be seen in more detail, which may extend approximately parallel to the rear face 108 of the exterior cladding panel 100. Further, the locking leg 107 may include a first edge 111, shown as an upper edge in FIG. 5, and a second edge 112, shown as a lower edge in FIG. 5. The locking leg 107 may be attached to the rear face 108 of the exterior cladding panel 100 along the second edge 112, which is shown in more detail in FIG. 6.

Figure 6:
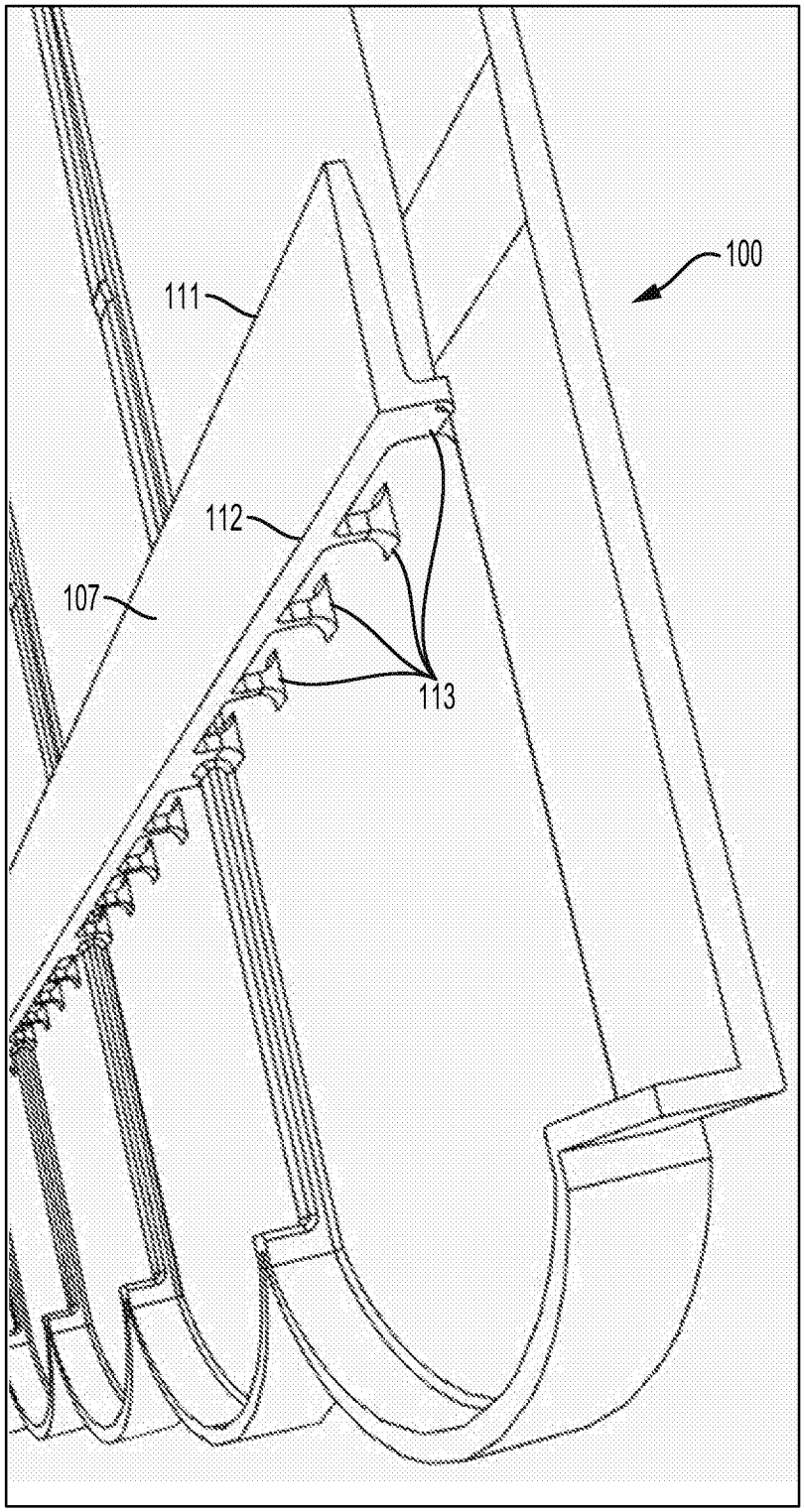
FIG. 6 is another schematic perspective view of a rear face of an exterior cladding panel according to another embodiment of the disclosure.

FIG. 6 illustrates another schematic perspective view of the rear face 108 of the exterior cladding panel 100, and shows an example where the locking leg 107 is attached to the rear face 108 of the exterior cladding panel 100 by a plurality of interspaced ribs 114 extending from the second edge 112 of the locking leg 107. In some implementations, the plurality of interspaced ribs 114 may be desirable over other alternatives, such as a continuous connection. For instance, where the exterior cladding panel 100 is manufactured via injection molding, attaching the locking leg 107 to the rear face 108 may result in a sink mark, or depression, on the front face 104 of the exterior cladding panel 100, opposite the connection. This may cause a visual defect, as even a minor sink mark may be noticeable if it runs across the entire horizontal length of the exterior cladding panel 100, which includes otherwise vertically oriented shingles and gaps.

Accordingly, the ribs 113 may be interspaced far enough from each other such that the injection molding process does not produce a noticeable sink mark on the front face 104 of the exterior cladding panel 100. At the same time, the plurality of interspaced ribs 113 must be numerous enough and/or have a sufficient enough cross section to adequately secure the exterior cladding panel 100 to the locking clip(s) an adjacent exterior cladding panel, we well as withstand any additional design loading, such as wind loads. In some implementations, the locking leg 107 may be attached to each shingle in the series of simulated shingles 105 by at least four interspaced ribs from the plurality of interspaced ribs 113. For instance, as shown in FIG. 6, the locking leg 107 is attached to the first shingle (and each other shingle in the series of simulated shingles 105) by five interspaced ribs from the plurality of interspaced ribs 113.

Figure 7:
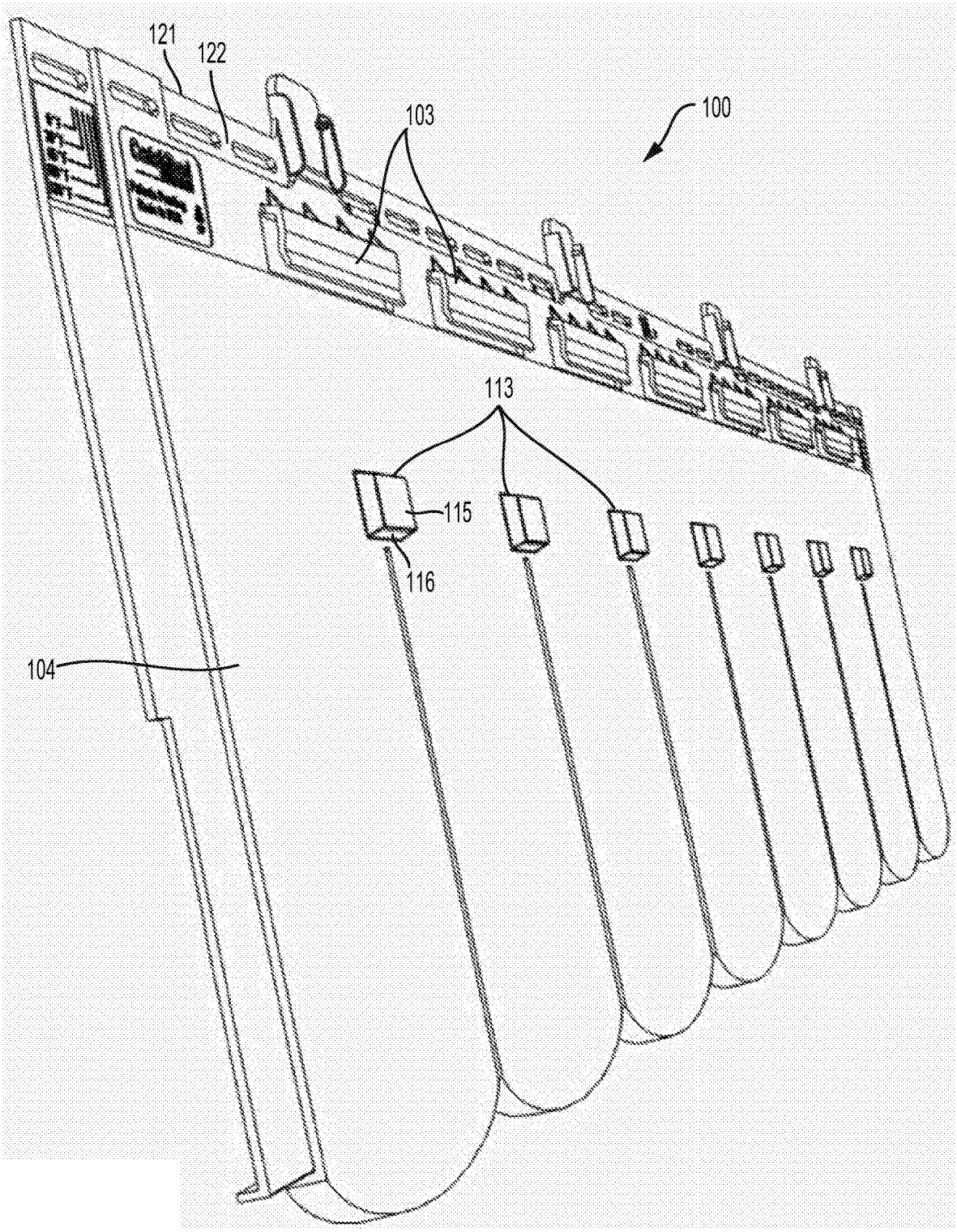
FIG. 7 is a schematic perspective view of a front face of an exterior cladding panel according to another embodiment of the disclosure.

Referring now to FIG. 7, a schematic perspective view of the front face 104 of an example exterior cladding panel 100 is shown. As can be seen in FIG. 7, each locking clip in the second series of locking clips 113 may be formed from a protrusion 115 extending from the front face 104 of the exterior cladding panel 100. Further, a portion 116 of each protrusion 115 facing the second end 102 of the exterior cladding panel 100 may be separable from the front face 104 of the exterior cladding panel 100 to form each locking clip in the second series of locking clips 113. However, FIG. 7 depicts an initial stage following the formation of the exterior cladding panel 100 where, for each protrusion 115, the portion 116 facing the second end 102 of the exterior cladding panel 100 is not yet separated from the front face 104 of the exterior cladding panel 100. Similarly, the back side of each protrusion 115 can be seen in FIG. 5, where no portion of the protrusion is yet separated from the front face 104.

Figure 8:
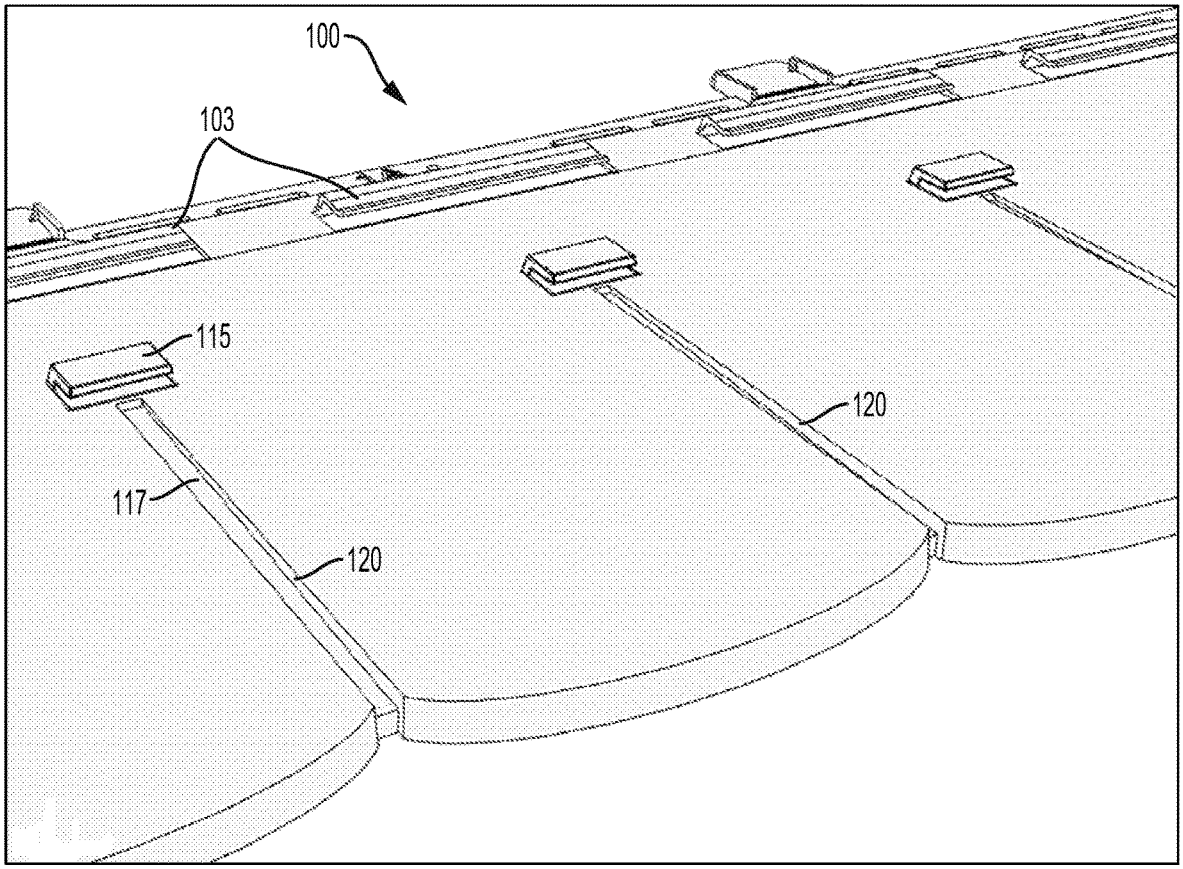
FIG. 8 is another schematic perspective view of a front face of an exterior cladding panel according to another embodiment of the disclosure.

FIG. 8 illustrates another schematic perspective view of the front face 104 of the exterior cladding panel 100, where the portion 116 of each protrusion 115 facing the second end 102 of the exterior cladding panel 100 has been separated from the front face 104. The portion 116 facing the second end 102 generally represents the bottom of each protrusion 115 in the example shown. As shown in FIG. 8, respective side portions of each protrusion 115 may be separated from the front face 104 as well, resulting in a second series of locking clips 113 with a shape that is relatively similar to that of the first series of locking clips 113.

In certain embodiments as otherwise described herein, the separation of the relevant portion(s) of each protrusion 115 from the front face 104 may be accomplished by cutting them away from each protrusion 115, with a utility knife, for example. To facilitate this, the exterior cladding panel 100 may be formed such that the portion 116 of each protrusion 115 to be cut away includes a relatively thin layer of plastic material, or flashing. In this way, each protrusion 115 in the second series of locking clips 113 can remain connected to the front face 104 of the exterior cladding panel 100 on all sides if the second series of locking clips 113 are not going to be used for a particular application. In these applications, a throughway for moisture to pass through the exterior cladding panel 100 is not created unnecessarily.

FIG. 8 also provides a closer view of a few gaps in the series of gaps 106. In particular, FIG. 8 illustrates that, in some embodiments as otherwise described herein, each gap in the series of gaps 106 may include a depth 120 measured normal to the front face 104 of the exterior cladding panel 100. Further, the depth 120 of each gap in the series of gaps 106 may increase from the middle portion 109 of the exterior cladding panel 100 toward the second end 102 of the exterior cladding panel 100.

For example, as shown in FIG. 8, the exterior cladding panel 100 may include a recessed portion 117 that is positioned within each gap, which may provide additional structural integrity for the exterior cladding panel 100. Accordingly, the depth of each gap may be measured from the front face 104 to the recessed portion 117 of the exterior cladding panel 100. The depth may be relatively shallow at the top end of each gap, near the second series of locking clips 113. The depth 120 may then increase along the length of each gap, as shown in FIG. 8.

This variation in the depth along each gap may provide variation in the shadow line created by each gap, which may be desirable in some implementations. In some embodiments, the gradient or slope of the recessed portion 117 within each gap may be the same, and thus the depth of each gap with vary in the same manner. In other embodiments, the slope of the recessed portion 117 may differ between different gaps, which, in combination with other examples discussed herein, may result in gaps having both a differing width and a differing depth within the series of gaps 106.

Figure 9:
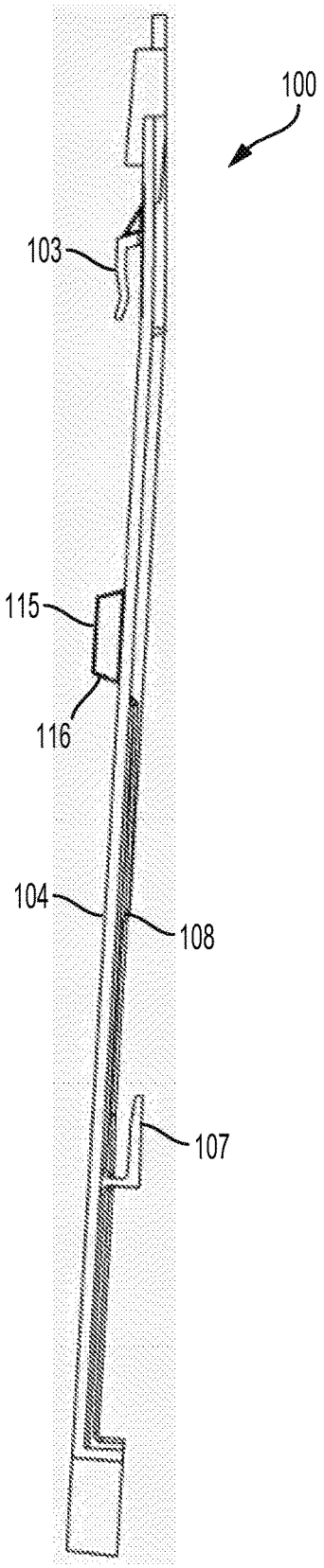
FIG. 9 is a schematic right side view of an exterior cladding panel according to another embodiment of the disclosure.
Figure 10:
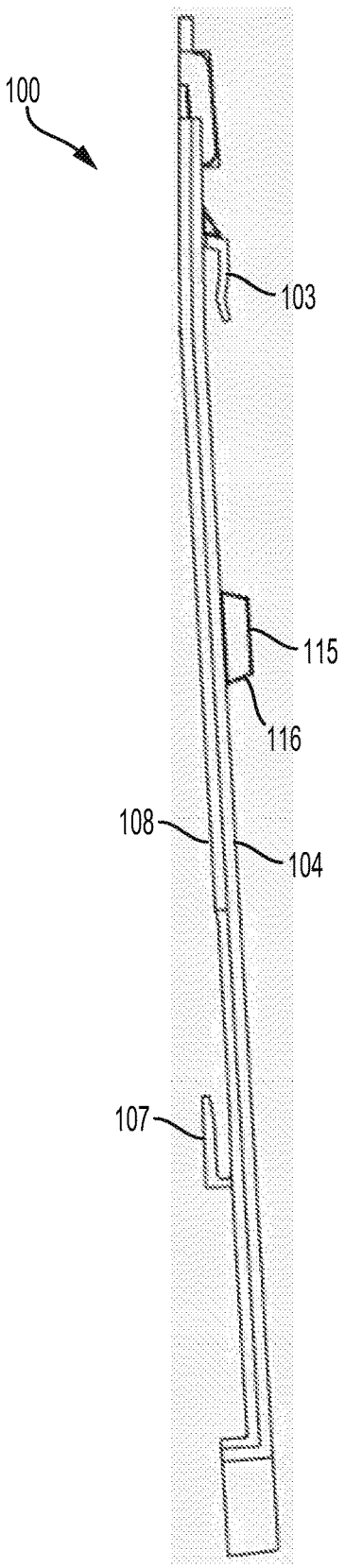
FIG. 10 is a schematic left side view of an exterior cladding panel according to another embodiment of the disclosure.

Turning now to FIGS. 9 and 10, a schematic right side view and a schematic left side view of an example exterior cladding panel 100 are shown, respectively. Some of the features discussed above can be seen, including the first series of locking clips 103 and the second series of locking clips 113. For each protrusions 115 second series of locking clips 113, the separable portion 116 has not yet been separated from the front face of the exterior cladding panel 100, as discussed above with respect to FIGS. 7-8, Further, the locking leg 107 is shown, extending approximately parallel to the rear face 108 of the exterior cladding panel 100.

Figure 11:
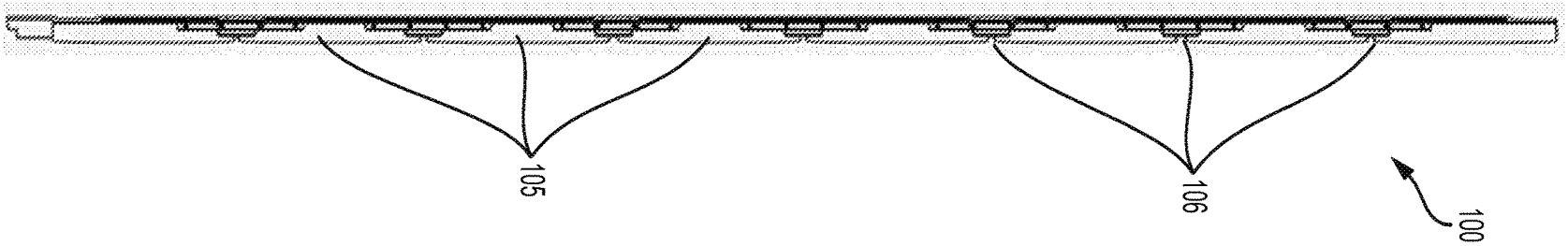
FIG. 11 is a schematic top view of an exterior cladding panel according to another embodiment of the disclosure.
Figure 12:
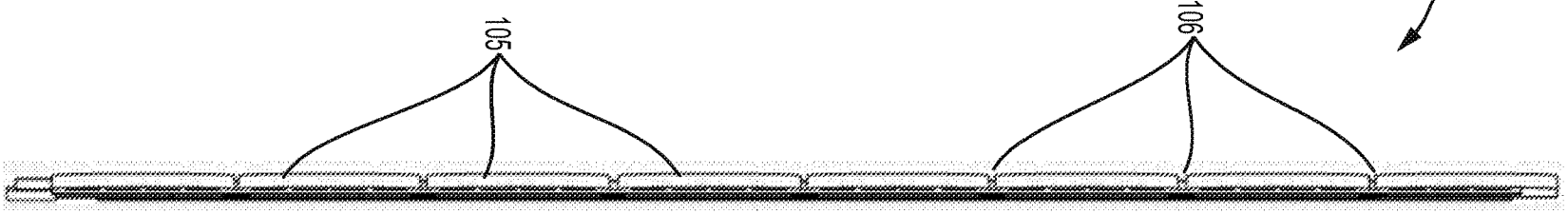
FIG. 12 is a schematic bottom view of an exterior cladding panel according to another embodiment of the disclosure.

FIGS. 11 and 12 depict a schematic top view and a schematic bottom view, respectively, of an example exterior cladding panel 100. Due to the relatively thin profile of the exterior cladding panel 100, relatively few features of the exterior cladding panel 100 are visible in the top and bottom views shown in FIGS. 11 and 12, although the series of simulated shingles 105 and the series of gaps 106 can be seen.

Figure 13:
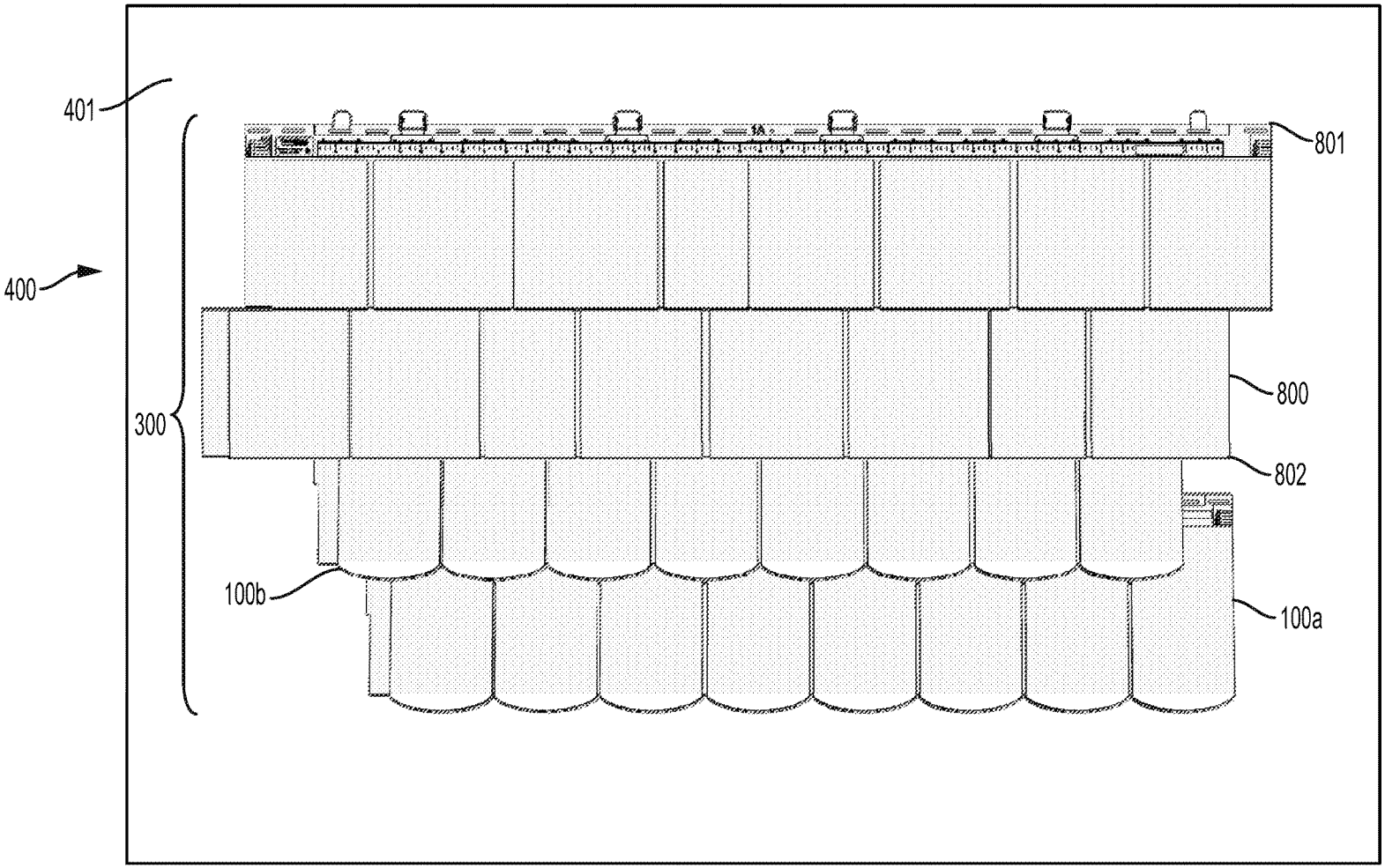
FIG. 13 is a schematic perspective view of a partially installed exterior cladding system according to another embodiment of the disclosure.

Referring now to FIG. 13, a schematic perspective view of a partially installed exterior cladding system 300 according to another embodiment of the disclosure is shown. However, it will be understood that the exterior cladding system 300 need not be installed or partially installed for all components of the system to be present. For instance, the exterior cladding system 300 may include a first exterior cladding panel 100*a* and a second exterior cladding panel 100*b*, both of which may be substantially similar or the same as the exterior cladding panel 100 shown in FIGS. 1-12 and discussed in examples herein. Further, the locking leg 107 of the second exterior cladding panel 100*b* may be sized to engage the series of locking clips 103 of the first exterior cladding panel 100*a*.

Because the locking leg 107 is positioned in the middle portion 109 of the exterior cladding panel 100*b*, as can be seen most clearly by reference to the exterior cladding panel 100 in FIG. 5, the second end 102 of the exterior cladding panel 100*b*, when installed, will overhang the entire top portion 102 and some of the middle portion 109 of the exterior cladding panel 100*a*. This overhang will cover, for example, the unused second series of locking clips 113, and position the bottommost edge of the second exterior cladding panel 100*b* at the top of the series of gap 106 in the first exterior cladding panel 100*a*, as can be seen in the partially assembled view in FIG. 13.

Additionally or alternatively, the exterior cladding system 300 may include a first panel 100*b*, where the first panel 100*b* is substantially similar to or the same as the exterior cladding panel 100 shown in FIGS. 1-12 and discussed above. In particular, the exterior cladding panel 100*b* may include the second series of locking clips 113. Further the system 300 may include a second exterior cladding panel 800, such as the exterior cladding panel 800 shown in FIG. 13, which includes double course of simulated shingles. Exterior cladding panel 800 may include a first end 801 and a second end 802. Further, unlike the first exterior cladding panel 100*b*, the exterior cladding panel 800 may include a locking leg extending along a bottom edge of the second end 802 of the second exterior cladding panel 800. The locking leg of the second exterior cladding panel 800 may be sized to engage the second series of locking clips 113 of the first exterior cladding panel 100*b*.

Accordingly, this example arrangement of the exterior cladding system 300 illustrates a situation where the second series of locking clips 113 is used. Because the locking leg of the second exterior cladding panel 800 is situated at the bottom edge of the exterior cladding panel 800, there is no remaining panel to overhang the first exterior cladding panel 100*b*. Thus, if the locking leg of the second exterior cladding panel 800 may be sized to engage the second series of locking clips 113, such that the bottommost edge of the second exterior cladding panel 800 is positioned at the top of the series of gap 106 in the first exterior cladding panel 100*b*, as can be seen in the partially assembled view in FIG. 13.

Further, FIG. 13 shows a wall 400 of a structure including an exterior sheathing 401, and the exterior cladding system 300 as discussed in some of the examples above partially attached thereto. For instance, the exterior cladding panel 100*a* may be fastened to the exterior sheathing 401 via a fastening strip disposed along an edge of the first end of the exterior cladding panel 100*a*, such as the fastening strip 122 shown with respect to the exterior cladding panel 100 in FIG. 1. Further, the locking leg of the second exterior cladding panel 100*b*, which may be substantially similar to or the same as the locking leg 107 shown in FIGS. 4-6, may be engaged with a series of locking clips of the first exterior cladding panel 100*a*, which may be substantially similar to or the same as the series of locking clips 103 shown in FIG. 7.

Additionally or alternatively, the wall 400 may include the exterior sheathing 401 and the exterior cladding system 300 as discussed in some other examples above attached thereto. For instance, the exterior cladding panel 100*b* may be fastened to the exterior sheathing 401 via a fastening strip disposed along an edge of the first end of the exterior cladding panel 100*b*, such as the fastening strip 122 shown with respect to the exterior cladding panel 100 in FIG. 1. Further, the locking leg of the second exterior cladding panel 800, which may be situated at the bottom edge of the exterior cladding panel 800, may be engaged with a second series of locking clips of the first exterior cladding panel 100*b*, which may be substantially similar to or the same as the second series of locking clips 113 shown in FIG. 8.

Figure 14:
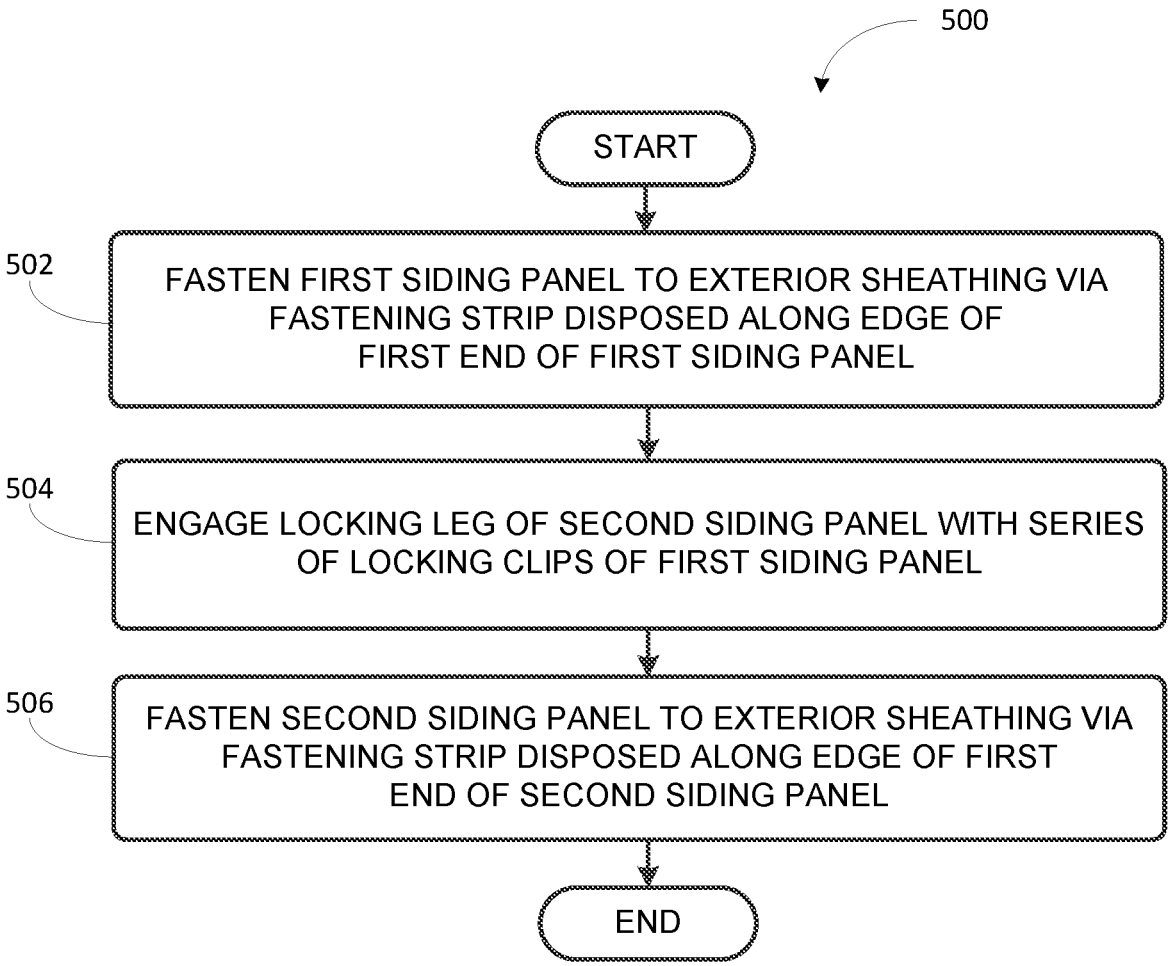
FIG. 14 is a block diagram of a method for installing an exterior cladding system according to another embodiment of the disclosure.

FIG. 14 is a block diagram of a method 500 for installing an exterior cladding system, such as the exterior cladding system 300 according to some examples discussed herein, onto a wall of a structure according to an embodiment of the disclosure.

At block 502, the method 500 includes fastening the first exterior cladding panel 100*a* to the exterior sheathing 401 via a fastening strip disposed along an edge of the first end of the first exterior cladding panel 100*a*, For example, the fastening strip may be substantially similar to or the same as fastening strip 122 shown with respect to the exterior cladding panel 100 in FIG. 1, and the first exterior cladding panel 100*a* may be fastened to the exterior sheathing 401 via nails driven through slots in the fastening strip 122. Staples and other fasteners may be utilized as well.

At block 504, the method 500 includes engaging the locking leg, such as a locking leg 107 as discussed above, of the second exterior cladding panel 100*b* with the series of locking clips, such as the series of locking clips 103, of the first exterior cladding panel 100*a*.

At block 506, the method 500 includes fastening the second exterior cladding panel 100*b* to the exterior sheathing 401 via a fastening strip disposed along the edge of the first end of the second exterior cladding panel 100*b*. As noted above, the fastening strip may be the substantially similar to or the same as fastening strip 122 disposed along the edge 121 of the first end 102 of the exterior cladding panel 100 shown in FIG. 1.

Figure 15:
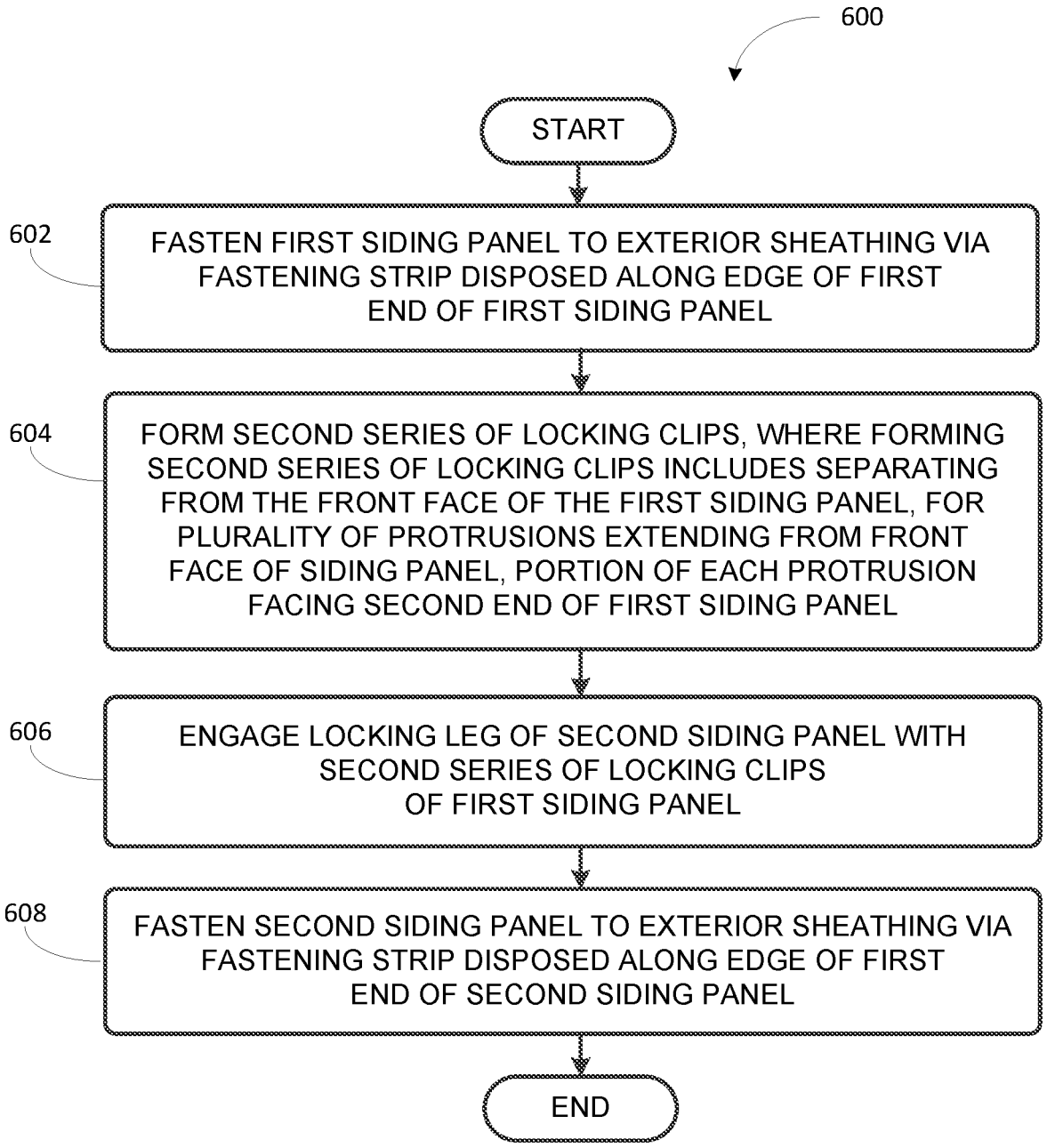
FIG. 15 is a block diagram of a method for installing an exterior cladding system according to another embodiment of the disclosure.

FIG. 15 is a block diagram of a method 600 for installing an exterior cladding system, such as the exterior cladding system 300 according to some examples discussed herein, onto a wall of a structure according to another embodiment of the disclosure.

At block 602, the method 600 includes fastening the first exterior cladding panel 100*b* to the exterior sheathing 401 via a fastening strip disposed along an edge of the first end of the first exterior cladding panel 100*b*. For instance, the fastening strip may the fastening strip 122 shown with respect to the exterior cladding panel 100 in FIG. 1, and the first exterior cladding panel 100*b* may be fastened to the exterior sheathing 401 via nails driven through slots in the fastening strip 122. Staples and other fasteners may be utilized as well.

At block 604, the method 600 includes forming the second series of locking clips. As noted above, the second series of locking clips may be substantially similar to or the same as the second series of locking clips 113 discussed in the examples above. Further, forming the second series of locking clips 113 may include separating from the front face of the first exterior cladding panel 100*b*, for a plurality of the protrusions 115 extending from the front face of the exterior cladding panel 100*b*, the portion 116 of each protrusion 115 facing the second end of the first exterior cladding panel 100*b*. For instance, as mentioned previously, the portion 116 may be cut away using a utility knife or other similar tool. Moreover, forming the second series of locking clips 113 may include separating other portions of each protrusion as well, such as their respective side portions, as shown in FIG. 8.

At block 606, the method 600 includes engaging the locking leg of a second exterior cladding panel 800, which may be situated at the bottom edge of the exterior cladding panel 800, with the second series of locking clips 113 of the first exterior cladding panel 100*b*.

At block 608, the method 600 includes fastening the second exterior cladding panel 100*b* to the exterior sheathing 401 via a fastening strip disposed along the edge of the first end of the second exterior cladding panel 800. The fastening strip may be the substantially similar to or the same the other fastening strips discussed in the examples above.

Figure 16:
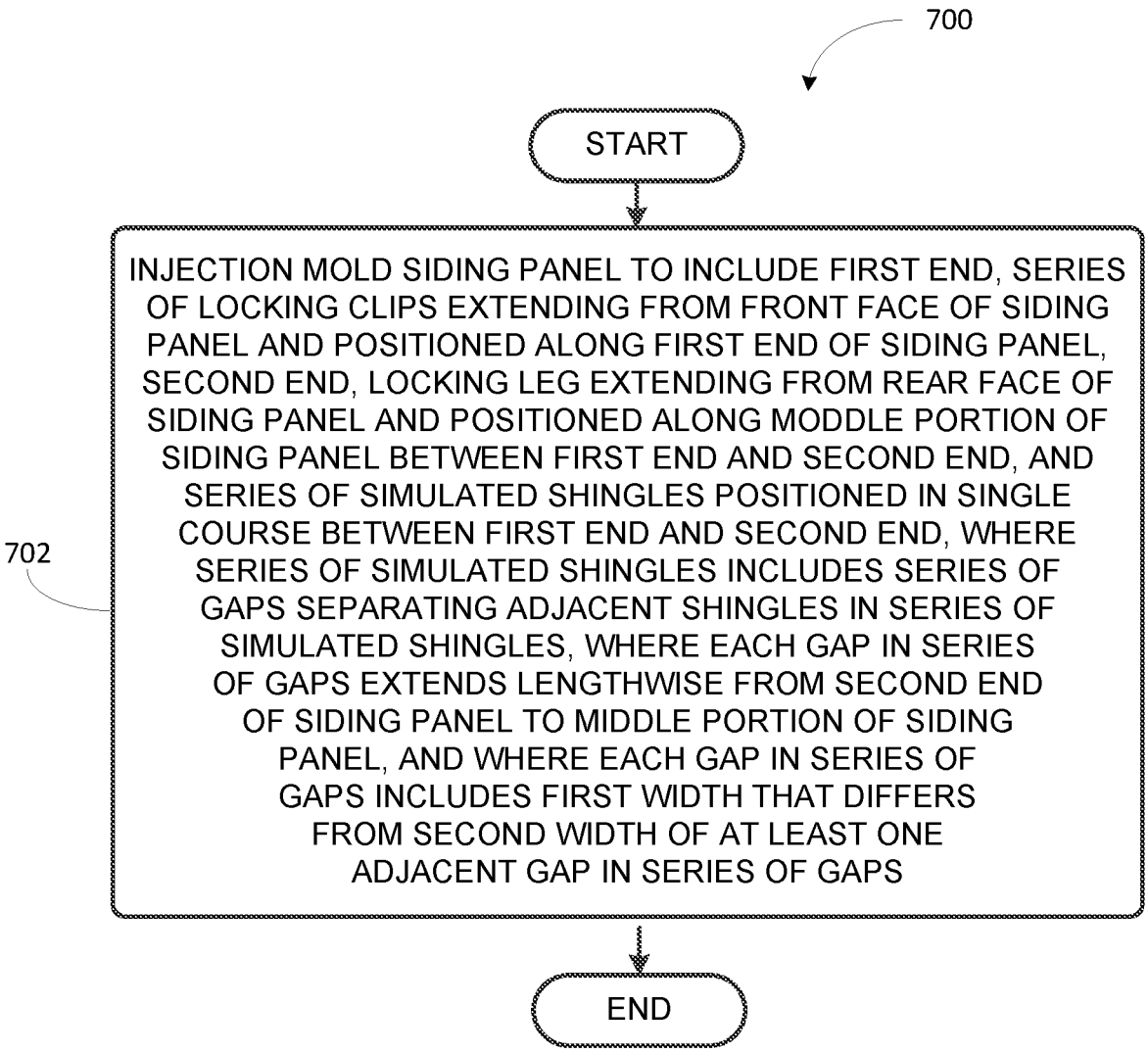
FIG. 16 is a block diagram of a method for forming an exterior cladding system according to another embodiment of the disclosure.

FIG. 16 is a block diagram of a method 700 for forming an exterior cladding panel, such as the exterior cladding panel 100 discussed herein, according to another embodiment of the disclosure.

At block 702, the method 700 includes injection molding the exterior cladding panel 100 to include a first end 101 and a series of locking clips 103 extending from a front face 104 of the exterior cladding panel 100 and positioned along the first end 101 of the exterior cladding panel 100, as shown in FIGS. 1-12 and discussed above. Further, the method 700 may include injection molding the exterior cladding panel 100 to include a second end 102, and a locking leg 107 extending from a rear face 108 of the exterior cladding panel 100 and positioned along a middle portion 109 of the exterior cladding panel 100 between the first end 101 and the second end 102.

The method 700 may also include injection molding the exterior cladding panel 100 to include a series of simulated shingles 105 positioned in a single course between the first end 101 and the second end 102. As discussed above and shown in the Figures, the series of simulated shingles 105 may include a series of gaps 106 separating adjacent shingles in the series of simulated shingles 105. Each gap in the series of gaps 106 may be injection molded to extend lengthwise from the second end 102 of the exterior cladding panel 100 to the middle portion 109 of the exterior cladding panel 100. Further, each gap in the series of gaps may be injection molded to include a first width 110*a* that differs from a second width 110*b* of at least one adjacent gap in the series of gaps 106.

In certain embodiments as otherwise described herein, the at least one adjacent gap in the series of gaps 106 is a first adjacent gap, and injection molding the exterior cladding panel 100 to include the series of simulated shingles 105 may include injection molding the series of gaps 106 such that the first width 110*a* also differs from a third width 110*c* of a second adjacent gap in the series of gaps 106, as shown in the example of FIG. 3. Further, the exterior cladding panel 100 may be injection molded to include at least three gaps having mutually different widths.

In some other implementations, the at least one adjacent gap in the series of gaps 106 is a first adjacent gap, and injection molding the exterior cladding panel 100 to include the series of simulated shingles 105 may include injection molding the series of gaps 106 such that the first width 110*a* is the same as a third width 110*a* of a second adjacent gap in the series of gaps 106, as shown in the example of FIG. 3 and discussed above.

In some embodiments, the series of locking clips 103 may be injection molded to correspond to the series of gaps 106 such that each locking clip in the series of locking clips 103 is aligned with a respective gap in the series of gaps 106. Further, the series of gaps 106 may be injection molded such that each gap in the series of gaps 106 includes a depth 120 measured normal to the front face 104 of the exterior cladding panel 100, and such that the depth 120 of each gap in the series of gaps 106 increases from the middle portion 109 of the exterior cladding panel 100 toward the second end 102 of the exterior cladding panel 100, as shown in FIG. 8 and discussed above.

In certain embodiments as otherwise described herein, injection molding the exterior cladding panel 100 to include the locking leg 107 may include injection molding the locking leg 107 to extend approximately parallel to the rear face 108 of the exterior cladding panel 100, such that the locking leg 107 comprises a first edge 111 and a second edge 112, and such that the locking leg 107 is attached to the rear face 108 of the exterior cladding panel 100 by a plurality of interspaced ribs 113 extending from the second edge 112 of the locking leg 107.

Further, in some implementation, injection molding the exterior cladding panel 100 to include the locking leg 107 may include injection molding the attachment of the locking leg 107 to the rear face 108 of the exterior cladding panel 100 such that the locking leg 107 is attached to each shingle in the series of simulated shingles 105 by at least four interspaced ribs as discussed above and as shown in FIG. 6.

In some examples, as noted above, the series of locking clips 103 may be a first series of locking clips 103, and injection molding the exterior cladding panel 100 may further include injection molding the exterior cladding panel 100 to include a second series of locking clips 113 extending from the front face 104 of the exterior cladding panel 100 and positioned in the middle portion 109 of the exterior cladding panel 100, between the series of the first locking clips 103 and the series of gaps 106. Further, in certain embodiments as otherwise described herein, injection molding the exterior cladding panel 100 to include the second series of locking clips 113 may include injection molding each locking clip in the second series of locking clips 113 as a protrusion 115 extending from the front face 104 of the exterior cladding panel 100, such that a portion 116 of each protrusion 115 facing the second end 102 of the exterior cladding panel 100 is separable from the front face 104 of the exterior cladding panel 100 to form each locking clip in the second series of locking clips 113.

In addition, and similar to the first series of locking clips 103 discussed above, injection molding the exterior cladding panel 100 to include the second series of locking clips 113 may include injection molding the second series of locking clips 13 to correspond to the series of gaps 106 such that each locking clip in the second series of locking clips 113 is aligned with a respective gap in the series of gaps 106.

Conventional methodologies for exterior cladding construction can be used in the installation and formation of the exterior cladding panels as described herein. Further, the embodiments and implementations described herein, in conjunction with the Figures, have generally discussed an exterior cladding system and an exterior cladding panel that is oriented with horizontally arranged courses, with reference to course and adjacent exterior cladding panels positioned in series both above and below. However, one of ordinary skill in the art will recognize that the exterior cladding panels, systems, and methods described herein are not limited to a horizontal arrangement. For instance, in certain embodiments as otherwise described herein, the exterior cladding panels and exterior cladding systems described above may be installed vertically, or at any angle between zero and ninety degrees. Exterior cladding panels may be installed in an orientation that matches the underlying surface to which the exterior cladding panels are applied, for instance, as well as for a variety of visual, structural, and/or thermal effects and performance.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. An exterior cladding panel comprising:

a first end;

a series of locking clips extending from a front face of the exterior cladding panel and positioned along the first end of the exterior cladding panel;

a second end;

a locking leg extending from a rear face of the exterior cladding panel and positioned along a middle portion of the exterior cladding panel between the first end and the second end, the locking leg including an upper edge and a lower edge, wherein the locking leg is attached to the rear face of the exterior cladding panel along the lower edge and is configured to engage a locking clip of an adjacent panel; and a series of simulated shingles positioned in a single course between the first end and the second end, wherein the series of simulated shingles comprises a series of gaps separating adjacent shingles in the series of simulated shingles, wherein each gap in the series of gaps extends lengthwise from the second end of the exterior cladding panel to the middle portion of the exterior cladding panel, and wherein each gap in the series of gaps comprises a first width that differs from a second width of at least one adjacent gap in the series of gaps.

2. The exterior cladding panel of claim 1, wherein the at least one adjacent gap in the series of gaps is a first adjacent gap, and wherein the first width also differs from a third width of a second adjacent gap in the series of gaps.

3. The exterior cladding panel of claim 1, wherein the at least one adjacent gap in the series of gaps is a first adjacent gap, and wherein the first width is the same as a third width of a second adjacent gap in the series of gaps.

4. The exterior cladding panel of claim 1, wherein the series of gaps comprises at least three gaps having mutually different widths.

5. The exterior cladding panel of claim 1, wherein the series of locking clips corresponds to the series of gaps such that each locking clip in the series of locking clips is aligned with a respective gap in the series of gaps.

6. The exterior cladding panel of claim 1, wherein each gap in the series of gaps comprises a depth measured normal to the front face of the exterior cladding panel, and wherein the depth of each gap in the series of gaps increases from the middle portion of the exterior cladding panel toward the second end of the exterior cladding panel.

7. The exterior cladding panel of claim 1, wherein the locking leg extends approximately parallel to the rear face of the exterior cladding panel, and wherein the locking leg is attached to the rear face of the exterior cladding panel by a plurality of interspaced ribs extending from the second edge of the locking leg.

8. The exterior cladding panel of claim 7, wherein the locking leg is attached to the rear face of the exterior cladding panel such that the locking leg is attached to each shingle in the series of simulated shingles by at least four interspaced ribs.

9. An exterior cladding comprising:

a first end;

a first series of locking clips a first series of locking clips extending from a front face of the exterior cladding panel and positioned along the first end of the exterior cladding panel;

a second end;

a locking leg extending from a rear face of the exterior cladding panel and positioned along a middle portion of the exterior cladding panel between the first end and the second end;

a series of simulated shingles positioned in a single course between the first end and the second end, wherein the series of simulated shingles comprises a series of gaps separating adjacent shingles in the series of simulated shingles, wherein each gap in the series of gaps extends lengthwise from the second end of the exterior cladding panel to the middle portion of the exterior cladding panel, and wherein each gap in the series of gaps comprises a first width that differs from a second width of at least one adjacent gap in the series of gaps; and a second series of locking clips extending from the front face of the exterior cladding panel and positioned in the middle portion of the exterior cladding panel, between the first series of locking clips and the series of gaps.

10. The exterior cladding panel of claim 9, wherein each locking clip in the second series of locking clips is formed from a protrusion extending from the front face of the exterior cladding panel, such that a portion of each protrusion facing the second end of the exterior cladding panel is separable from the front face of the exterior cladding panel to form each locking clip in the second series of locking clips.

11. The exterior cladding panel of claim 9, wherein the second series of locking clips corresponds to the series of gaps such that each locking clip in the second series of locking clips is aligned with a respective gap in the series of gaps.

12. An exterior cladding system comprising a first exterior cladding panel and a second exterior cladding panel, each exterior cladding panel comprising:

a first end;

a series of locking clips extending from a front face of the exterior cladding panel and positioned along the first end of the exterior cladding panel;

a second end;

a locking leg extending from a rear face of the exterior cladding panel and positioned along a middle portion of the exterior cladding panel between the first end and the second end; and a series of simulated shingles positioned in a single course between the first end and the second end, wherein the series of simulated shingles comprises a series of gaps separating adjacent shingles in the series of simulated shingles, wherein each gap in the series of gaps extends lengthwise from the second end of the exterior cladding panel to the middle portion of the exterior cladding panel, and wherein each gap in the series of gaps comprises a first width that differs from a second width of at least one adjacent gap in the series of gaps, wherein the locking leg of the second exterior cladding panel is sized to engage the series of locking clips of the first exterior cladding panel.

13. An exterior cladding system comprising:

a first exterior cladding panel, wherein the first exterior cladding panel is the exterior cladding panel of claim 8;

a second exterior cladding panel, wherein the second exterior cladding panel comprises:

a first end;

a second end; and a locking leg extending along an edge of the second end of the second exterior cladding panel; and wherein the locking leg of the second exterior cladding panel is sized to engage the second series of locking clips of the first exterior cladding panel.

14. A wall of a structure comprising an exterior sheathing and the exterior cladding system of claim 12 attached thereto, wherein the first exterior cladding panel is fastened to the exterior sheathing via a fastening strip disposed along an edge of the first end of the first exterior cladding panel, and wherein the locking leg of the second exterior cladding panel is engaged with the series of locking clips of the first exterior cladding panel.

15. A wall of a structure comprising an exterior sheathing and the exterior cladding system of claim 13 attached thereto, wherein the first exterior cladding panel is fastened to the exterior sheathing via a fastening strip disposed along an edge of the first end of the first exterior cladding panel, and wherein the locking leg of the second exterior cladding panel is engaged with the second series of locking clips of the first exterior cladding panel.

16. A method of installing an exterior cladding system according to claim 12, the method comprising:

fastening the first exterior cladding panel to the exterior sheathing via a fastening strip disposed along the edge of the first end of the first exterior cladding panel;

engaging the locking leg of the second exterior cladding panel with the series of locking clips of the first exterior cladding panel; and fastening the second exterior cladding panel to the exterior sheathing via a fastening strip disposed along the edge of the first end of the second exterior cladding panel.

17. A method of installing an exterior cladding system according to claim 13, the method comprising:

fastening the first exterior cladding panel to the exterior sheathing via a fastening strip disposed along the edge of the first end of the first exterior cladding panel;

forming the second series of locking clips, wherein forming the second series of locking clips comprises separating from the front face of the first exterior cladding panel, for a plurality of the protrusions extending from the front face of the exterior cladding panel, the portion of each protrusion facing the second end of the first exterior cladding panel;

engaging the locking leg of the second exterior cladding panel with the second series of locking clips of the first exterior cladding panel; and fastening the second exterior cladding panel to the exterior sheathing via a fastening strip disposed along the edge of the first end of the second exterior cladding panel.

18. A method of forming an exterior cladding panel according to claim 1, the method comprising:

injection molding the exterior cladding panel to include:

a first end;

a series of locking clips extending from a front face of the exterior cladding panel and positioned along the first end of the exterior cladding panel;

a second end;

a locking leg extending from a rear face of the exterior cladding panel and positioned along a middle portion of the exterior cladding panel between the first end and the second end; and a series of simulated shingles positioned in a single course between the first end and the second end, wherein the series of simulated shingles comprises a series of gaps separating adjacent shingles in the series of simulated shingles, wherein each gap in the series of gaps extends lengthwise from the second end of the exterior cladding panel to the middle portion of the exterior cladding panel, and wherein each gap in the series of gaps comprises a first width that differs from a second width of at least one adjacent gap in the series of gaps.

19. The method of claim 18, wherein the at least one adjacent gap in the series of gaps is a first adjacent gap, and wherein injection molding the exterior cladding panel to include the series of simulated shingles comprises injection molding the series of gaps such that the first width also differs from a third width of a second adjacent gap in the series of gaps.

20. The method of claim 18, wherein injection molding the exterior cladding panel to include the series of simulated shingles further comprises injection molding the series of gaps such that each gap in the series of gaps comprises a depth measured normal to the front face of the exterior cladding panel, and such that the depth of each gap in the series of gaps increases from the middle portion of the exterior cladding panel toward the second end of the exterior cladding panel.

21. A method of forming an exterior cladding panel according to claim 9, the method comprising:

injection molding the exterior cladding panel to include:

a first end;

a first series of locking clips extending from a front face of the exterior cladding panel and positioned along the first end of the exterior cladding panel;

a second end;

a locking leg extending from a rear face of the exterior cladding panel and positioned along a middle portion of the exterior cladding panel between the first end and the second end;

a series of simulated shingles positioned in a single course between the first end and the second end, wherein the series of simulated shingles comprises a series of gaps separating adjacent shingles in the series of simulated shingles, wherein each gap in the series of gaps extends lengthwise from the second end of the exterior cladding panel to the middle portion of the exterior cladding panel, and wherein each gap in the series of gaps comprises a first width that differs from a second width of at least one adjacent gap in the series of gaps; and a second series of locking clips extending from the front face of the exterior cladding panel and positioned in the middle portion of the exterior cladding panel, between the first series of locking clips and the series of gaps.

22. A method of forming an exterior cladding panel according to claim 12, the method comprising:

injection molding the exterior cladding panel to include:

a first end;

a series of locking clips extending from a front face of the exterior cladding panel and positioned along the first end of the exterior cladding panel;

a second end;

a locking leg extending from a rear face of the exterior cladding panel and positioned along a middle portion of the exterior cladding panel between the first end and the second end; and a series of simulated shingles positioned in a single course between the first end and the second end, wherein the series of simulated shingles comprises a series of gaps separating adjacent shingles in the series of simulated shingles, wherein each gap in the series of gaps extends lengthwise from the second end of the exterior cladding panel to the middle portion of the exterior cladding panel, and wherein each gap in the series of gaps comprises a first width that differs from a second width of at least one adjacent gap in the series of gaps, wherein the locking leg of the second exterior cladding panel is sized to engage the series of locking clips of the first exterior cladding panel.

* * * * *